US009174657B2

(12) United States Patent
Morris

(10) Patent No.: US 9,174,657 B2
(45) Date of Patent: Nov. 3, 2015

(54) AUTOMATED REAL-TIME POSITIVE TRAIN CONTROL TRACK DATABASE VALIDATION

(71) Applicant: LOCKHEED MARTIN CORPORATION, Bethesda, MD (US)

(72) Inventor: Charles W. Morris, Nokesville, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 245 days.

(21) Appl. No.: 13/839,453

(22) Filed: Mar. 15, 2013

(65) Prior Publication Data

US 2014/0263862 A1 Sep. 18, 2014

(51) Int. Cl.

| | |
|---|---|
| ***B61L 27/00*** | (2006.01) |
| ***B61L 3/12*** | (2006.01) |
| ***B61L 25/02*** | (2006.01) |
| *B61L 15/00* | (2006.01) |

(52) U.S. Cl.

CPC ..... *B61L 27/0077* (2013.01); *B61L 3/125* (2013.01); *B61L 25/025* (2013.01); *B61L 15/0027* (2013.01)

(58) Field of Classification Search

CPC . B61L 27/00; B61L 27/0077; B61L 27/0061; B61L 27/0072; B61L 27/0083; B61L 27/0088; B61L 27/0094

See application file for complete search history.

(56) References Cited

U.S. PATENT DOCUMENTS

| | | | | |
|---|---|---|---|---|
| 3,641,338 | A | 2/1972 | Peel et al. | |
| 4,582,280 | A | 4/1986 | Nichols et al. | |
| 5,129,605 | A | 7/1992 | Burns et al. | |
| 5,803,411 | A * | 9/1998 | Ackerman et al. | 246/169 R |
| 5,893,043 | A | 4/1999 | Moehlenbrink et al. | |
| 6,218,961 | B1 | 4/2001 | Gross et al. | |
| 7,162,337 | B2 | 1/2007 | Peltz et al. | |
| 7,395,141 | B1 | 7/2008 | Seck et al. | |
| 7,610,152 | B2 | 10/2009 | Meyer | |
| 8,392,103 | B2 | 3/2013 | Meyer et al. | |
| 2002/0027495 | A1 * | 3/2002 | Darby et al. | 340/298 |
| 2002/0049520 | A1 * | 4/2002 | Mays | 701/19 |

(Continued)

FOREIGN PATENT DOCUMENTS

DE 19628124 1/1998

OTHER PUBLICATIONS

US 6,550,976, 04/2003, Martins et al. (withdrawn)

*Primary Examiner* — Jason C Smith

(74) *Attorney, Agent, or Firm* — Hamre, Schumann, Mueller & Larson, P.C.

(57) ABSTRACT

Methods and systems are described that can be used to verify a track database of a train management system, for example that the track database has not been corrupted, built with critical errors, or is not being used properly by the software application. In one embodiment, radio frequency identification (RFID) tags are mounted on the trackside features contained in the track database. The tags contain data such as the geographical coordinates of the trackside features and a unique feature identifier that uniquely identifies the respective feature. As the train passes the trackside feature, a tag reader on the train reads the tag to gather the geographical coordinates and the feature identifier. The train management system then compares the geographical coordinates and/or the feature identifier from the tag with the expected geographical coordinates and/or the expected feature identifier in the track database.

7 Claims, 4 Drawing Sheets

(56) References Cited

U.S. PATENT DOCUMENTS

| | | | | |
|---|---|---|---|---|
| 2004/0068361 | A1* | 4/2004 | Cross et al. | 701/117 |
| 2004/0093196 | A1* | 5/2004 | Hawthorne et al. | 703/8 |
| 2005/0004722 | A1* | 1/2005 | Kane et al. | 701/19 |
| 2005/0107954 | A1 | 5/2005 | Nahla | |
| 2005/0205719 | A1* | 9/2005 | Hendrickson et al. | 246/122 R |
| 2005/0240322 | A1 | 10/2005 | Peltz et al. | |
| 2006/0047379 | A1* | 3/2006 | Schullian et al. | 701/19 |
| 2007/0152107 | A1* | 7/2007 | LeFebvre et al. | 246/169 R |
| 2007/0233335 | A1* | 10/2007 | Kumar et al. | 701/22 |
| 2008/0097659 | A1* | 4/2008 | Hawthorne | 701/19 |
| 2008/0128562 | A1 | 6/2008 | Kumar et al. | |
| 2008/0167767 | A1* | 7/2008 | Brooks et al. | 701/20 |
| 2008/0195265 | A1* | 8/2008 | Searle et al. | 701/19 |
| 2008/0312775 | A1* | 12/2008 | Kumar | 701/2 |
| 2009/0043435 | A1* | 2/2009 | Kane et al. | 701/19 |
| 2009/0090818 | A1 | 4/2009 | Kumar | |
| 2009/0177344 | A1* | 7/2009 | James et al. | 701/19 |
| 2009/0186325 | A1* | 7/2009 | Kumar | 434/219 |
| 2010/0004804 | A1* | 1/2010 | Anderson et al. | 701/19 |
| 2010/0023190 | A1* | 1/2010 | Kumar et al. | 701/20 |
| 2010/0063734 | A1* | 3/2010 | Kumar | 701/300 |
| 2010/0217462 | A1* | 8/2010 | Shaffer et al. | 701/19 |
| 2010/0235020 | A1* | 9/2010 | Meyer et al. | 701/19 |
| 2011/0153470 | A1* | 6/2011 | Miller et al. | 705/28 |
| 2012/0095677 | A1* | 4/2012 | Bell | 701/433 |
| 2012/0116616 | A1 | 5/2012 | Morris | |
| 2012/0130567 | A1* | 5/2012 | Noffsinger et al. | 701/19 |
| 2012/0130568 | A1* | 5/2012 | Golden et al. | 701/20 |
| 2013/0048795 | A1* | 2/2013 | Cross | 246/122 R |
| 2013/0144517 | A1* | 6/2013 | Kickbusch | 701/119 |
| 2014/0117168 | A1* | 5/2014 | Itagaki et al. | 246/34 R |
| 2014/0117169 | A1* | 5/2014 | Itagaki et al. | 246/34 R |
| 2014/0263862 | A1* | 9/2014 | Morris | 246/2 R |
| 2014/0277859 | A1* | 9/2014 | Morris | 701/19 |

* cited by examiner

*Fig. 2*

Deriving Geographic Coordinates from Partition Offset

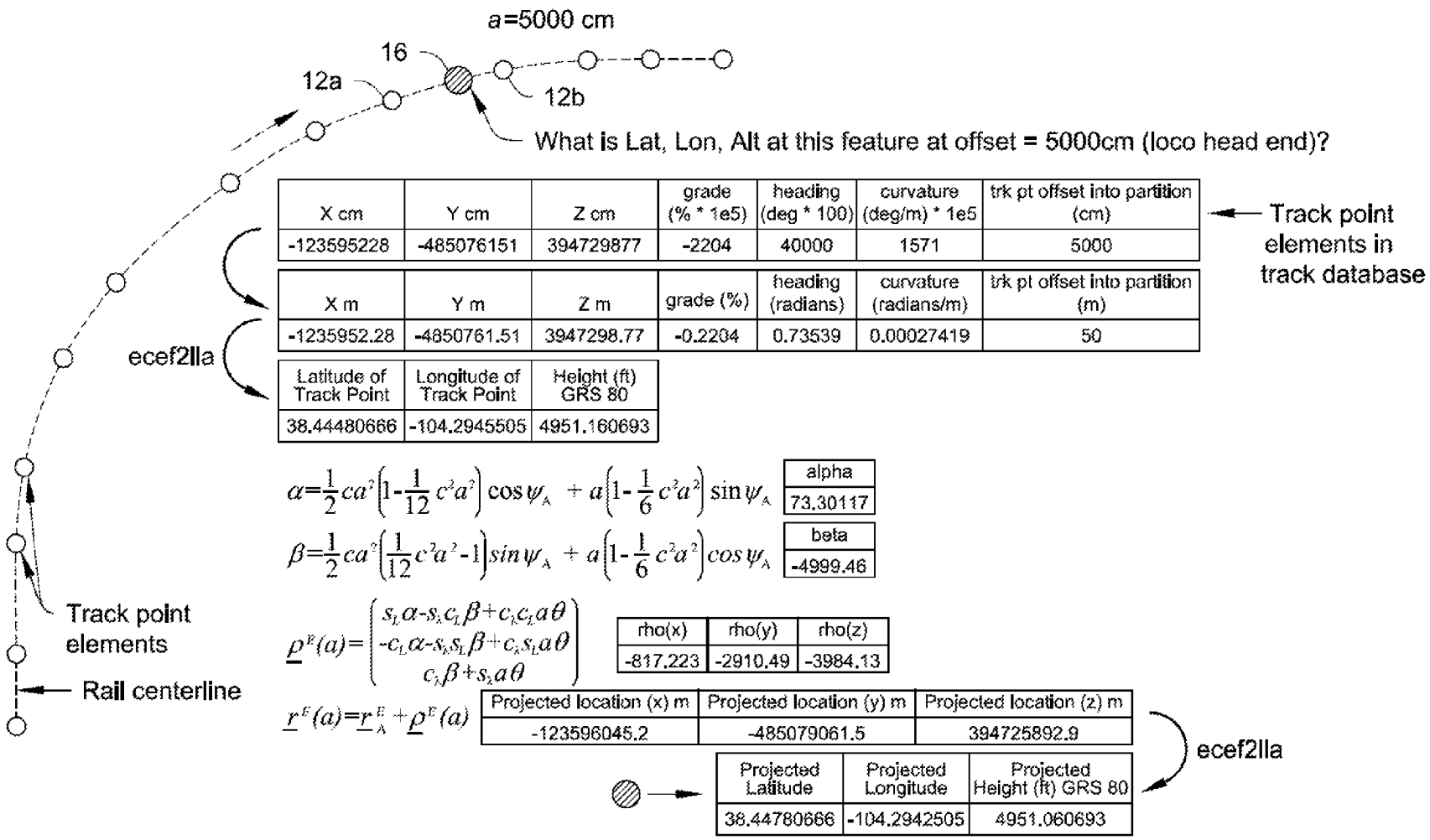

| X cm | Y cm | Z cm | grade (% * 1e5) | heading (deg * 100) | curvature (deg/m) * 1e5 | trk pt offset into partition (cm) |
|---|---|---|---|---|---|---|
| -123595228 | -485076151 | 394729877 | -2204 | 40000 | 1571 | 5000 |

| X m | Y m | Z m | grade (%) | heading (radians) | curvature (radians/m) | trk pt offset into partition (m) |
|---|---|---|---|---|---|---|
| -1235952.28 | -4850761.51 | 3947298.77 | -0.2204 | 0.73539 | 0.00027419 | 50 |

| Latitude of Track Point | Longitude of Track Point | Height (ft) GRS 80 |
|---|---|---|
| 38.44480666 | -104.2945505 | 4951.160693 |

$$\alpha=\frac{1}{2}ca^2\left(1-\frac{1}{12}c^2a^2\right)\cos\psi_A+a\left(1-\frac{1}{6}c^2a^2\right)\sin\psi_A$$

| alpha |
|---|
| 73.30117 |

$$\beta=\frac{1}{2}ca^2\left(\frac{1}{12}c^2a^2-1\right)\sin\psi_A+a\left(1-\frac{1}{6}c^2a^2\right)\cos\psi_A$$

| beta |
|---|
| -4999.46 |

$$\underline{\rho}^E(a)=\begin{pmatrix} s_L\alpha-s_Ac_L\beta+c_Lc_Ia\theta \\ -c_L\alpha-s_As_L\beta+c_As_La\theta \\ c_A\beta+s_Ia\theta \end{pmatrix}$$

| rho(x) | rho(y) | rho(z) |
|---|---|---|
| -817.223 | -2910.49 | -3984.13 |

$$\underline{r}^E(a)=\underline{r}_A^E+\underline{\rho}^E(a)$$

| Projected location (x) m | Projected location (y) m | Projected location (z) m |
|---|---|---|
| -123596045.2 | -485079061.5 | 394725892.9 |

| Projected Latitude | Projected Longitude | Projected Height (ft) GRS 80 |
|---|---|---|
| 38.44780666 | -104.2942505 | 4951.060693 |

AUTOMATED REAL-TIME POSITIVE TRAIN CONTROL TRACK DATABASE VALIDATION

FIELD

This disclosure relates to the field of train management systems and increasing safety in such systems.

BACKGROUND

One example of a train management system is the Lockheed Martin Advanced Train Management System (ATMS) that uses on-train processing and advanced digital communications to keep track of and manage the location and speeds of trains on a railway. This permits railroads to increase capacity by reducing distance between trains and increase reliability through better on-time performance. In addition, safety is increased through authority and speed limit enforcement.

The ATMS uses a track database containing a variety of data including geographical coordinates of a number of trackside features that are disposed along the railway tracks as well as a unique identifier for each of the trackside features. The track database is used to create a virtual model of the track in the control system of the train.

Track databases have many components that are constructed by a team of surveyors, software operators, database administrators, and other staff, and are distributed by radio links to trains from central data servers. However, the track database can have errors. The track line's 3-D trajectory can have errors (location/curvature/heading/grade), which can degrade the ability to accurately compute offset into track segment. In addition, errors in feature-coordinate assignments can result in erroneous visual presentation of upcoming trackside features and track line characteristics to train crew and can have several unintended consequences. For example, errors in content can result in erroneously determining train's track occupancy (parallel track), computing actual location along a track, affecting braking enforcement distance calculations, and miss-identifying physical features used in authority limits.

Physical trackside features such as kilometer posts, turnouts, speed limits, passenger platforms, division boundaries, yard limits, etc. are used for two-way traffic management and speed management. However, these trackside features can have errors in their partition offsets which results in track database content errors. In addition, trackside features such as kilometer posts and control points can be unintentionally swapped along the track line (for example kilometer post 130 is actually 129 and vice versa). For this example, an authority issued between kilometer posts 135 and 130 on single track could cause an unintentional physical conflict with an opposing train travelling in the opposite direction, as their movement authorities are generated and deconflicted by km post value by a train dispatcher/controller, not by geographic coordinates.

SUMMARY

Methods and systems are described that can be used to verify a track database of a train management system, for example that the track database has not been corrupted, built with critical errors, or is not being used properly by the software application.

In some circumstances, software and hardware data of a train management system have to meet safety integrity level (SIL) 3 and above compliance. One recognized way to meet SIL requirements for the underlying ATMS track database is to create and use an independent database, which has the characteristics of a different design, different creation method, generated by a different process with different assets, and maintained by different team members.

The described methods and systems provide real time, continual, train centric techniques to ensure that each train is using its part of the track database without safety reducing navigation errors, is processing the track database correctly, and has correct information on the actual placement of trackside features so that the actual placements match the track database contents which is used to construct the virtual model of the track.

In one embodiment, radio frequency identification (RFID) tags are mounted on the trackside features contained in the track database. The tags contain data such as the geographical coordinates of the trackside features and a unique feature identifier that uniquely identifies the respective feature. As the train passes the trackside feature, a tag reader on the train reads the tag to gather the geographical coordinates and the feature identifier. The train management system then compares the geographical coordinates and/or the feature identifier from the tag with the expected geographical coordinates and/or the expected feature identifier in the track database.

An advantage of the described methods and systems is that the team or individuals that load the data into the RFID tags can be independent from the team that created the track database. This diversity and independence between the two teams are important attributes for a SIL environment.

In one embodiment, the RFID tag is mounted on the trackside feature in a vertical orientation, and the RFID reader on the train has a wide vertical field of view, and a narrow horizontal field of view, in order to detect the trackside feature's passing when it is close to broadside to the train. In one example, the RFID reader is located in the engine or locomotive of the train, such as adjacent to the front end of the locomotive. However, the RFID reader can be located at other locations on the train as long as its location is accounted for when comparing the read RFID data to the expected data from the track database. In addition, in some embodiment, more than one RFID reader may be provided on the train, with each RFID reader reading the RFID tag as it passes the trackside feature.

In one specific embodiment, a method of verifying a railway track database of a train management system is provided. The track database contains information on a plurality of trackside features located adjacent to a railway track including an identifier that uniquely identifies each trackside feature and a geographical coordinate location of each trackside feature. In this example, the method includes, as the train is traveling on the railway track, reading a radio frequency identification tag that is affixed to a first one of the trackside features using a reader disposed on the train. The reader obtains from the tag a feature identifier that uniquely identifies the first trackside feature and geographical coordinates of the first trackside feature, where the feature identifier and the geographical coordinates are stored in memory of the tag. The feature identifier and the geographical coordinates read by the reader are then compared with an expected identifier and expected geographical coordinates obtained from the track database.

In another specific embodiment, a method includes, as a train is traveling on a railway track and passes a trackside feature disposed adjacent to the railway track, reading data from a radio frequency identification tag disposed on the trackside feature using a reader located on the train.

In still another specific embodiment, a method includes mounting radio frequency identification tags to a plurality of trackside features adjacent to a railway track, each tag having memory in which is stored geographical coordinates of the trackside feature to which the tag is fixed and a feature identifier that uniquely identifies the trackside feature to which the tag is fixed.

In still another specific embodiment, a radio frequency identification tag includes a tag body, an antenna on the tag body, and memory on the tag body. The memory includes stored therein geographical coordinates of a railway trackside feature to which the RFID tag is intended to be or has been fixed and a feature identifier that uniquely identifies the railway trackside feature to which the RFID tag is intended to be or has been fixed.

In addition, a system includes a plurality of radio frequency identification tags mounted to a plurality of trackside features disposed adjacent to a railway track, each tag having memory in which is stored geographical coordinates of the trackside feature to which the tag is fixed and a feature identifier that uniquely identifies the trackside feature to which the tag is fixed. The system also includes a tag reader mounted on a train, the tag reader is capable of reading the radio frequency identification tags as the train passes the trackside features, and a processor on the train that is connected to the tag reader, the processor receiving the geographical coordinates and the feature identifier of each tag from the tag reader.

DRAWINGS

FIG. 2 is a diagram illustrating one embodiment of deriving geographic coordinates from a partition offset using data from a track database.

DETAILED DESCRIPTION

Figure 1:
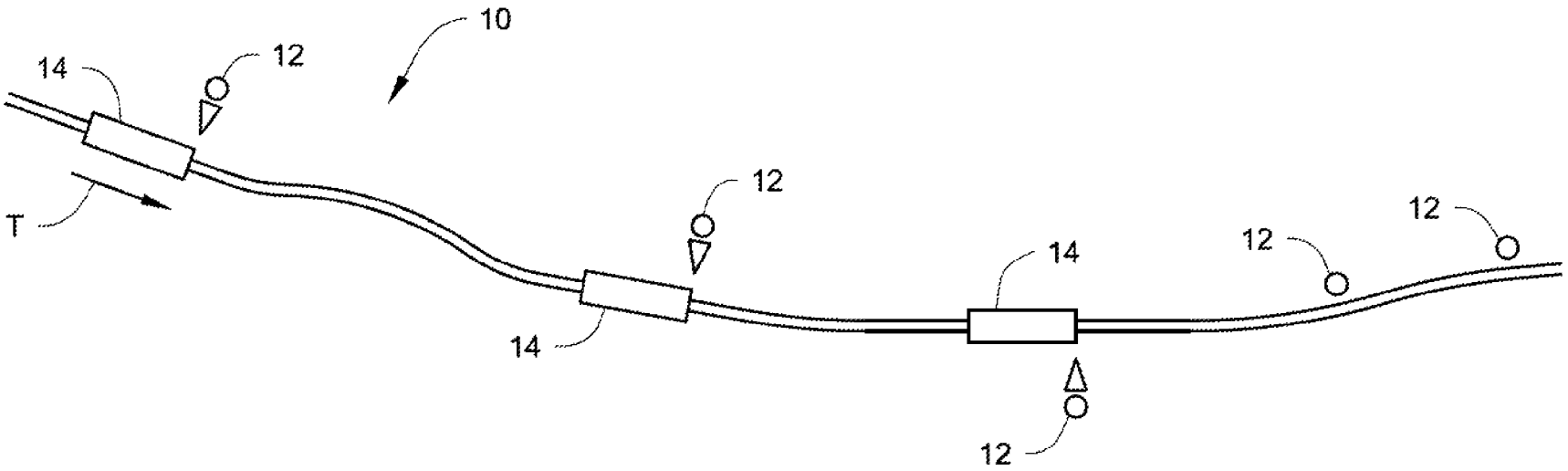
FIG. 1 illustrates a virtual model of a railway track line with trackside features.

With reference initially to FIG. 1, a virtual model of a railway track line 10 as one may see displayed as part of a train management system is illustrated along with a plurality of trackside features 12 disposed on either side of the track line. The track line 10 represents the centerline of the railway on which a train 14 is travelling in the direction T. FIG. 1 shows the train at different times as it travels along the track.

The trackside features 12 can be any structures typically located along a railway track that are used for such tasks as traffic and/or speed management including, but not limited to, kilometer posts, turnouts, speed limits, division boundaries, yard limits, etc.

The track line 10 can be any railway track on which a train travels including, but not limited to cargo, freight, passenger, and/or commuter train tracks. The train 14 generally includes a locomotive or engine and one or more additional cars connected to the locomotive.

The train 14 is controlled by a train management system on the train, typically on the locomotive, that includes a track database that is used to keep track of the location and speed of the train on the track. The function and construction of track databases and train management systems is well known to those having ordinary skill in the art. An example of a track database is described in U.S. Pat. No. 8,392,103.

When it is created, the track database contains the geographical coordinates of some or all of the trackside features 12 as well as a unique identifier for each of the trackside features in the track database. The train management system includes a location determination unit (LDU), such as a head end rail guide, that determines instantaneous offset into track partition and uses the track database to determine current geographic coordinates from the offset. For example, with reference to FIG. 2, the position of the locomotive 16 of the train is shown as being offset a distance, for example 5000 cm, between two consecutive trackside features 12*a*, 12*b*. The track database knows the geographical coordinates of the trackside features 12*a*, 12*b* which have been stored in the database. Therefore, the geographical coordinates of the locomotive at the offset position can be determined. FIG. 2 illustrates an exemplary calculation that takes place to determine the geographical coordinates of the locomotive 16 at the offset location. Further information on calculating partition offset can be found in U.S. Patent Application Publication 2012/0116616 filed on Nov. 9, 2011, which is incorporated herein by reference in its entirety.

This calculation of the geographical coordinates and the use of the geographical coordinates of the trackside features 12*a*, 12*b* is used by the train management system to help control operation of the train. However, as indicated above, there could be errors in the track database that can result in errors in the coordinate calculations as well as errors in advising the train operators which trackside features they are coming up on or have passed. Therefore, a continual, train-based means to validate the data in the track database would be useful.

Figure 3:
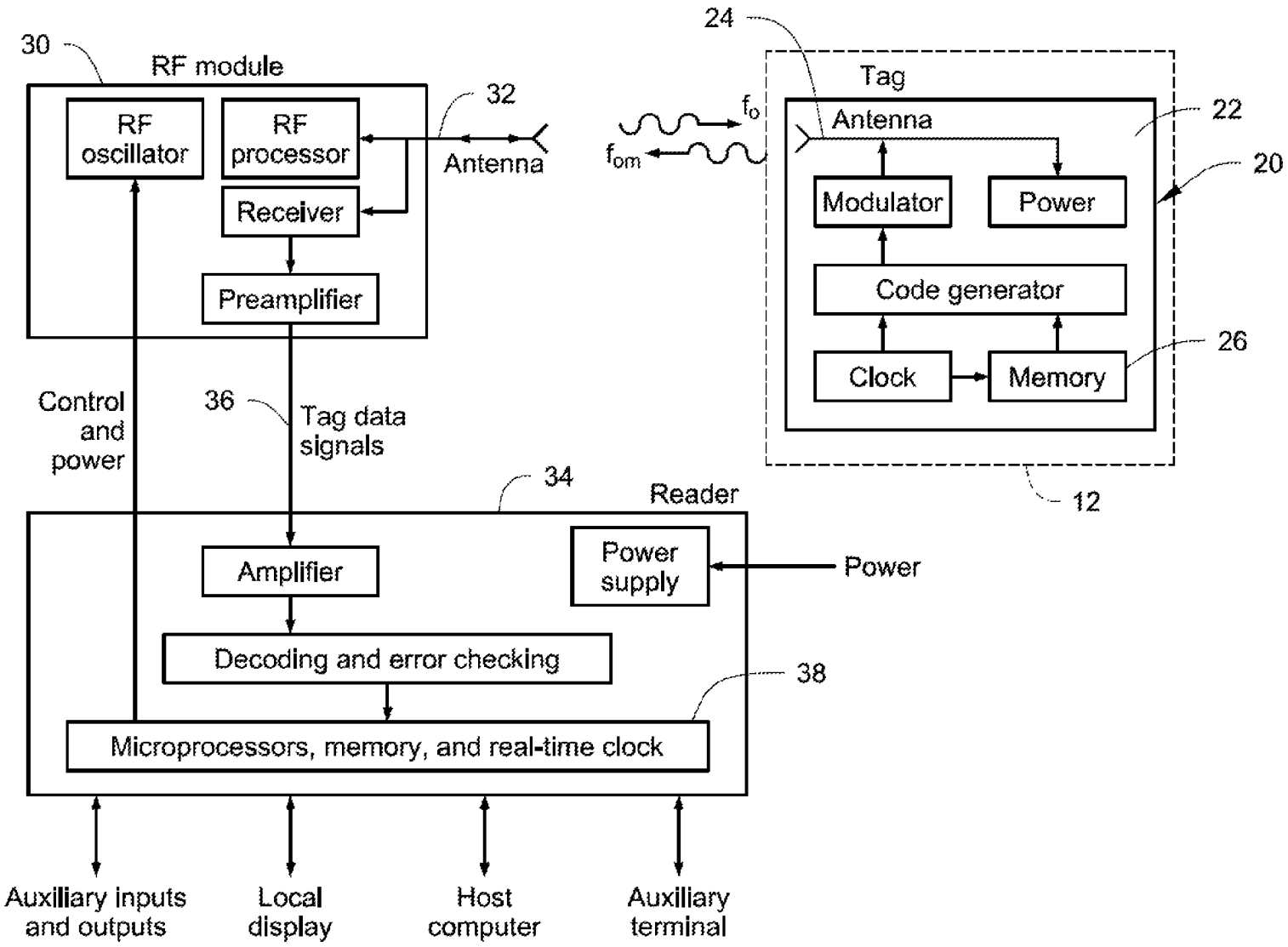
FIG. 3 illustrates an RFID system that can be used to verify the track database.

With reference to FIG. 3, the track database can be validated in real-time using an RFID system. In particular, each of the trackside features 12 (corresponding to the trackside features stored in the track database) is provided with an RFID tag 20. The RFID tag 20 is of standard mechanical and electrical construction including a tag body 22, an antenna 24 embedded in or otherwise disposed on the tag body, memory 26 for storing data, and other conventional elements.

In one embodiment, the tags 20 are mounted on the trackside features 12 and programmed by a crew that is independent from the team involved with creating the track database. This independence greatly reduces the chances that a common error is made both in the track database and in the tag 20.

For each tag 20, the crew loads into the memory 26 a feature identifier that uniquely identifies the trackside feature 12 to which that tag will be or has been mounted, as well as the geographical coordinates of that trackside feature. The loading of the data into each tag 20 can occur prior to or when the tag is mounted on the trackside feature. The geographical coordinates for each trackside feature 12 can be obtained using a conventional GPS receiver, which are then loaded into the tag memory 26. The loading of the data into tag memory can occur via wired or wireless means well known in the art.

The feature identifier in tag memory can be any identifier that uniquely identifies the feature, and in one embodiment matches the feature identifier stored in the track database for the corresponding feature. The feature identifier can be any number and combination of alphanumeric characters and symbols.

The geographical coordinates loaded into the tag memory 26 can be any coordinates that directly or indirectly indicate the geographical location of the feature. In one embodiment, the geographical coordinates are 3-D Cartesian coordinates (Earth Centered Earth Fixed) that indicate the location on Earth, which can also be represented as Geodetic coordinates by latitude, longitude and altitude of the trackside feature.

The RFID system also includes an RFID tag reader 30 that is used to read the data from the memory 26 of the RFID tags 20 on the trackside features. The tag reader 30 is mounted on the train at any location that is suitable for reading the tags 20. In one embodiment, the tag reader 30 is mounted at or adjacent to the front or head end of the locomotive or other forwardmost unit of the train. The tag reader 30 is of conventional construction including an antenna 32 and suitable communication electronics.

The tag reader 30 is in communication with a control unit 34 that receives the tag data signals 36 from the tag reader 30. The control unit 34 includes a microprocessor 38 that is programmed to take the data from the tag memory 26 and use that data to validate the data in the track database.

In one embodiment the RFID tags 20 are mounted on the trackside features 12 so that the tags 20 extend vertically. In addition, the reader 30 on the train is designed to have a wide vertical field of view and a narrow horizontal field of view in order to detect the trackside feature's passing when it is close to broadside to the locomotive.

Figure 4:
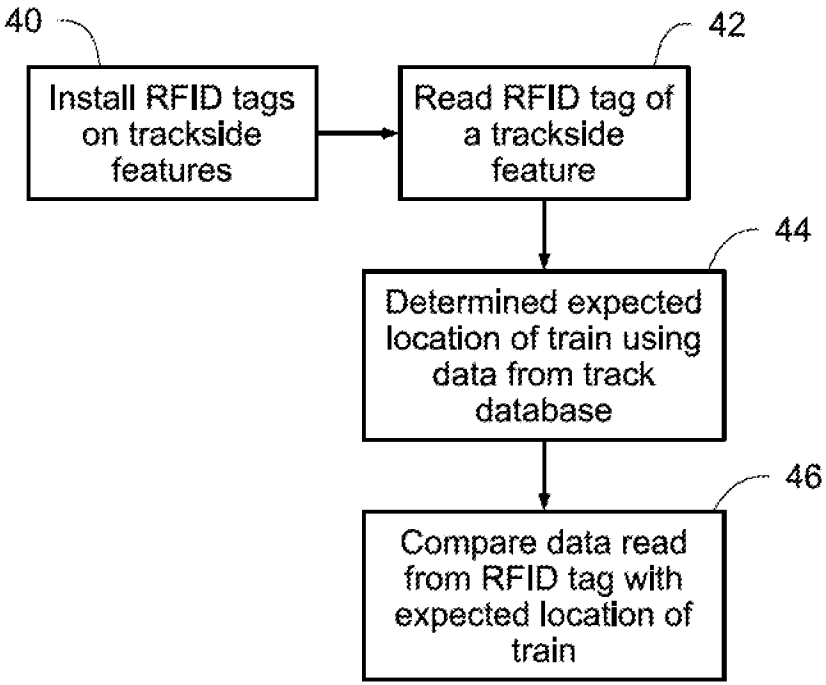
FIG. 4 illustrates one example of verifying a railway track database.

With reference to FIG. 4, in one process 40 the RFID tags 20 are installed on the trackside features 12. Either prior to or after mounting the tags, the geographical coordinates and the unique feature identifier for that feature are loaded into the tag memory 26.

In another part of the process, as the train moves down the track and passes one of the trackside features, the reader 30 reads the tag 20 on that trackside feature as indicated in box 42. As the head end of the train sequentially encounters trackside features with tags, the reader 30 responds with an event time, and reads the geographical data (e.g. the 3-D Cartesian coordinates or the Geodetic coordinates latitude/longitude/altitude) and the unique feature identifier.

The train management system also determines the expected location of the train using data from the track database as indicated at box 44. In this step, the head end LDU captures the instantaneous offset into track partition at that trackside feature, and computes equivalent geographic coordinates in the manner illustrated in FIG. 2.

The data read from the RFID tag is then compared to the expected location data as indicated at box 46. The train management system differences the LDU determined location at the event with the data read from the tag 20. This can be simplistically stated as LAT/LON/ALT of the locomotive minus LAT/LON/ALT of the trackside feature. However, in actuality the Cartesian coordinate components would be individually differenced.

If the locomotive is navigating properly (e.g. not built up an offset error), and if the trackside features and track geometry model in the complex track database are correct for that partition, then the coordinates read from the RFID tag will be very close (for example under 3 meters, or even within 1-2 meters) to those computed by the train borne computer. This event would be given a pass. Small differences confirm performance of the train management system and data correctness in the track database. Therefore, the geographical coordinates need not be identical in order to determine that there is a match.

The unique identifier read from the RFID tag matching the track database feature identifier confirms the correct trackside feature known to be at this location.

Any errors in either the geographical coordinates or the unique identifier can be logged and sent to a central location, such as a train management system office, and the train can be dropped out of automatic control.

If there is a match of feature identifier and coordinate locations, that means, at that time and for that train, the LDU's computed offset into partition is correct, the underlying track database is correct (at that time), and the train's crew operational display is correctly showing the track line and trackside features (but not features ahead of it). This type of checking is temporal, not continuous, only occurring every 1 km or less, depending on trackside feature density.

In an alternate embodiment, one could verify the coordinates without verifying the identifier, and vice versa.

This described method of cross checking, being physically performed on the track, also has beneficial use as a way to verify proper database content for both the underlying track database, the data in the tag memory, and LDU navigation performance, after track physical maintenance and database updates are put in place. In other words, it is a good test and verification tool to be employed after track and data changes are implemented on the network.

In addition to or separately from the track database validation described above, the systems and methods described herein can be used for other train management purposes. For example, since the geographical coordinates of the trackside features are known and the time between two readings is known, reading the tags of two consecutive trackside features can be used to determine the rate of travel between the trackside features and thus as a check of the speed of the train.

In addition, although the systems and methods have been described above as employing a single tag reader on the train, a train can have multiple tag readers spread along the length of the train. Each tag reader can read the tag on the trackside feature as the train passes. Failure of a reader to read the tag can indicate a potential problem with the train, such as decoupling of cars of the train from the locomotive.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of verifying a railway track database of a train management system, the track database contains information on a plurality of trackside features located adjacent to a railway track including an identifier that uniquely identifies each trackside feature and a geographical coordinate location of each trackside feature, the method comprising:

as the train is traveling on the railway track, reading a radio frequency identification tag that is affixed to a first one of the trackside features using a reader disposed on the train, the reader obtaining from the tag a feature identifier that uniquely identifies the first trackside feature and geographical coordinates of the first trackside feature, where the feature identifier and the geographical coordinates are stored in memory of the tag; and comparing the feature identifier and the geographical coordinates read by the reader with an expected identifier and expected geographical coordinates obtained from the track database.

2. The method of claim 1, wherein the expected identifier and expected geographical coordinates are calculated by a processor on the train.

3. The method of claim 1, wherein the reader is located on an engine of the train, and the tag is located in a vertical orientation on the trackside feature.

4. The method of claim 1, further comprising reading additional radio frequency identification tags that are affixed to additional trackside features using the reader, the reader obtaining from each additional tag a feature identifier that uniquely identifies the additional trackside feature and geographical coordinates of the additional trackside feature, where the feature identifier and the geographical coordinates are stored in memory of each additional tag; and for each additional radio frequency identification tag that is read, comparing the feature identifier and the geographical coordinates read by the reader with an expected identifier and expected geographical coordinates obtained from the track database.

5. A system, comprising:

a plurality of radio frequency identification tags mounted to a plurality of trackside features disposed adjacent to a railway track, each tag having memory in which is stored geographical coordinates of the trackside feature to which the tag is fixed and a feature identifier that uniquely identifies the trackside feature to which the tag is fixed;

a tag reader mounted on a train, the tag reader is capable of reading the radio frequency identification tags as the train passes the trackside features; and a processor on the train and connected to the tag reader, the processor receiving the geographical coordinates and the feature identifier of each tag from the tag reader.

6. The system of claim 5, wherein the tag reader is located on an engine of the train, and each of the tags is located in a vertical orientation on the trackside features.

7. The system of claim 5, wherein for each tag, the processor compares the feature identifier and the geographical coordinates read by the tag reader with an expected identifier and expected geographical coordinates obtained from a track database.

* * * * *